US010117558B1

(12) United States Patent
Restrepo

(10) Patent No.: US 10,117,558 B1
(45) Date of Patent: Nov. 6, 2018

(54) ADHESIVE SCRUBBING PATCH SET FOR ADHERING TO A GLOVE

(71) Applicant: Luis Alberto Restrepo, Alpharetta, GA (US)

(72) Inventor: Luis Alberto Restrepo, Alpharetta, GA (US)

( * ) Notice: Subject to any disclaimer, the term of this patent is extended or adjusted under 35 U.S.C. 154(b) by 301 days.

(21) Appl. No.: 15/213,903

(22) Filed: Jul. 19, 2016

Related U.S. Application Data

(60) Provisional application No. 62/201,412, filed on Aug. 5, 2015.

(51) Int. Cl.
*A47L 13/18* (2006.01)
*A47L 17/00* (2006.01)
*A41D 19/00* (2006.01)

(52) U.S. Cl.
CPC ..... *A47L 13/18* (2013.01); *A41D 19/0024* (2013.01); *A41D 19/0082* (2013.01); *A47L 17/00* (2013.01)

(58) Field of Classification Search
CPC . A46B 5/04; A47L 13/18; A47L 13/19; A47L 17/00; A47L 17/04; A47L 17/06; A47L 17/08; A41D 19/00; A41D 19/0003; A41D 19/0024; A41D 19/01594; A41D 19/0055; A41D 19/0058; A41D 19/0062; A41D 19/0082
USPC ..... 15/227; 2/159, 160, 161.6
See application file for complete search history.

(56) References Cited

U.S. PATENT DOCUMENTS 3,643,386 A * 2/1972 Grzyll ..... A41D 19/0055 15/227
6,098,234 A * 8/2000 Jackson, Jr. ..... A47K 7/02 15/104.94
7,823,245 B2 * 11/2010 Firouzman ..... A47L 13/18 15/118
2011/0004974 A1 * 1/2011 Firouzman ..... A47L 13/12 2/161.8

FOREIGN PATENT DOCUMENTS

FR 2582212 * 11/1986
GB 2382018 * 5/2003

* cited by examiner

*Primary Examiner* — Mark Spisich
(74) *Attorney, Agent, or Firm* — H. John Rizvi; Gold & Rizvi, P.A.

(57) ABSTRACT

A scrubbing patch set for gloves is provided including an inner hand patch sized and configured to generally cover the index finger, the thumb and an inner palm portion extending from the index finger to the thumb on the palm side of the glove. The patch set can also include a middle finger patch sized and configured to generally cover at least a distal end of the middle finger on the palm side of the glove; a ring finger patch sized and configured to generally cover at least a distal end of the ring finger on the palm side of the glove; and a little finger patch sized and configured to generally cover at least a distal end of the little finger on the palm side of the glove.

20 Claims, 7 Drawing Sheets

ADHESIVE SCRUBBING PATCH SET FOR ADHERING TO A GLOVE

CROSS-REFERENCE TO RELATED APPLICATIONS

This application claims the benefit of U.S. Provisional Patent Application Ser. No. 62/201,412, filed Aug. 5, 2015, which is incorporated herein in its entirety.

FIELD OF THE INVENTION

The present invention relates generally to cleaning and scrubbing utensils and devices, and more particularly, to an adhesive scrubbing patch set which can be applied to different portions or regions of a glove to impart dishware gripping and scrubbing capabilities to the glove.

BACKGROUND OF THE INVENTION

Household dishware is commonly washed by first manually rinsing the dishware in a sink followed by washing of the dishware in an automatic dishwasher. The dishware may be rinsed by manually grasping the dishware with one hand while applying a sponge, brush or cloth with dishwashing soap to the dishware. However, the dishware may have a tendency to inadvertently slip from the hand of the washer, potentially breaking the dishware in the sink.

Dishwashing gloves may be donned by a person washing the dishware, in order to protect the user's hands from prolonged exposure to water and dishwashing soap chemicals. Conventional dishwashing gloves normally include an inner fabric which is coated by an outer rubber material. The fabric provides a soft touch to the user's hands, while the outer rubber material renders the gloves impermeable.

Although the rubber materials used to manufacture the outer rubber coating or layer is somewhat non-slip, it has been observed in practice that the rubber may become slippery under wet conditions, resulting in the aforementioned problem of the dishware inadvertently slipping from the hands of the person.

Another drawback of manual dishwashing is that the user must concentrate not only on securely holding the dishware, but also on correctly gripping the sponge, brush or cloth with respect to the dishware in order to achieve optimum dishwashing results.

Accordingly, there is an established need for an improvement to current dishwashing or cleaning gloves which is capable of facilitating the task of dishwashing when wearing a pair of dishwashing or cleaning gloves.

SUMMARY OF THE INVENTION

The present invention is directed to a scrubbing patch set for gloves which can be applied to different portions or regions of a glove to impart dishware scrubbing capabilities to the glove. The scrubbing patch set enhances effective removal of food residue from the dishware, not requiring the use of a sponge, brush, cloth or the like. The scrubbing patch can also contribute to a non-slip grip of the dishware.

The scrubbing patch set for gloves includes an inner hand patch sized and configured to generally cover the index finger, the thumb portion and an inner palm portion extending therebetween, on the palm side of the glove; a middle finger patch sized and configured to generally cover at least a distal end of the middle finger on the palm side of the glove; a ring finger patch sized and configured to generally cover at least a distal end of the ring finger on the palm side of the glove; and a little finger patch sized and configured to generally cover at least a distal end of the little finger on the palm side of the glove. The scrubbing patch set as described heretofore is capable of covering sufficient areas of a glove to provide easy, comfortable, rapid and effective scrubbing and rinsing of the dishware without having to use a sponge, brush, cloth or the like.

In a first implementation of the invention, a scrubbing patch set is provided for adhering to a glove having a thumb, an index finger, a middle finger, a ring finger, a little finger and a palm side, the palm side comprising a thumb portion, an index finger portion, a middle finger portion, a ring finger portion, a little finger portion and an inner palm portion extending from the index finger portion to the thumb portion. The scrubbing patch set includes an adhesive, inner hand patch sized and configured to cover the index finger portion, the inner palm portion, and the thumb portion on the palm side. The scrubbing patch set further includes an adhesive, middle finger patch sized and configured to cover at least a distal end of the middle finger portion on the palm side. In addition, an adhesive, ring finger patch is further included, sized and configured to cover at least a distal end of the ring finger portion on the palm side. The scrubbing patch set also includes an adhesive, little finger patch sized and configured to cover at least a distal end of the little finger portion on the palm side.

In a second aspect, the inner hand patch can be elongated and strip-shaped.

In another aspect, the middle finger patch can cover at least a distal one-third of the middle finger portion on the palm side. The ring finger patch can cover at least a distal one-third of the ring finger portion on the palm side. The little finger patch can cover at least a distal one-third of the little finger portion on the palm side.

In another aspect, at least one of the inner hand patch, the middle finger patch, the ring finger patch and the little finger patch can include an adhesive patch body and a cover or film attached to the patch body and removable from the patch body to expose an adhesive back of the patch body. Preferably, all patches include such an adhesive patch body and removable cover or film.

In yet another aspect, at least one of the inner hand patch, the middle finger patch, the ring finger patch and the little finger patch is flexible and deformable to adopt a flat, planar position. Preferably, all patches are flexible and deformable to adopt a flat, planar position, so that the scrubbing patch set can be provided in an initial, flat configuration which is easy to store and transport.

In another aspect, the inner hand patch can include an index finger tip portion, an index finger middle portion which extends from the index finger tip portion, an index finger base portion which extends from the index finger middle portion, an inner palm portion which extends from the index finger base portion, a finger junction portion which extends from the inner palm portion, a thumb base portion which extends from the finger junction portion, a thumb middle portion which extends from the thumb base portion and a thumb tip portion which extends from the thumb middle portion.

In another aspect, the inner hand patch, the middle finger patch, the ring finger patch and the little finger patch can be fabricated of at least one of nylon, polyester, polyester cotton thread, polyester pad, nylon pad, cotton thread polyester, polyester sponge material, PET, non-woven fabric, microfiber 100% polyester, cloth, wool, duster, towel, flaw, wiper, natural scrubber, natural bristle, flexible silicon and natural sisal.

In yet another aspect, at least one of the inner hand patch, the middle finger patch, the ring finger patch and the little finger patch can be configured to further cover a side of a corresponding finger at least partially. Optionally, the at least one of the inner hand patch, the middle finger patch, the ring finger patch and the little finger patch can also cover a back of the corresponding finger at least partially, the back being opposite to said palm side.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a scrubbing patch set for gloves which can be applied to different portions or regions of a glove to impart dishware scrubbing capabilities to the glove. The scrubbing patch set for gloves facilitates effective removal of food residue from the dishware, and can contribute to a more secure gripping of the dishware. The scrubbing patch set can also be attached directly onto a user's fingers, if desired.

Figure 1:
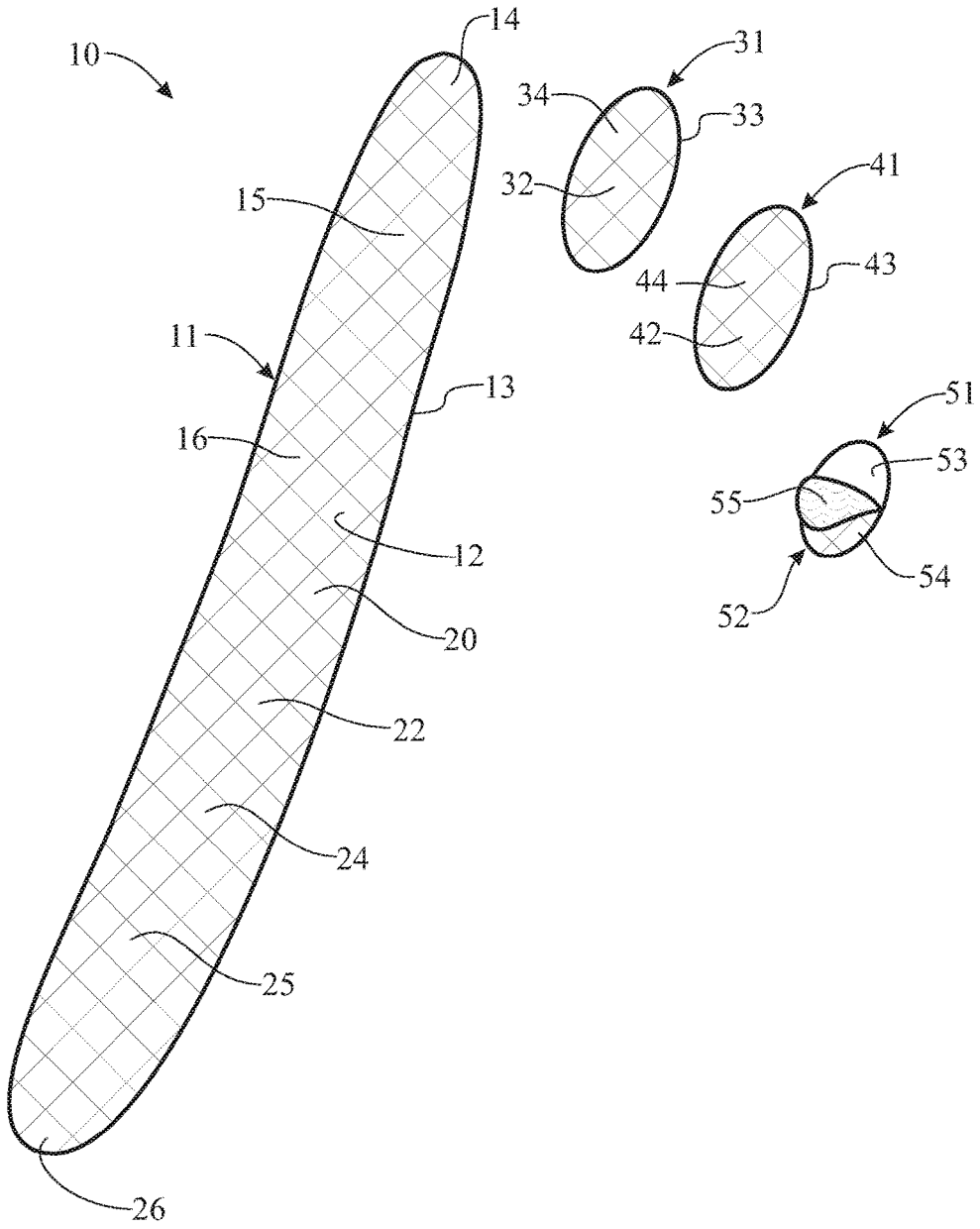
FIG. 1 presents an isometric view of an illustrative embodiment of the scrubbing patch set for gloves of the present invention.
Figure 2:
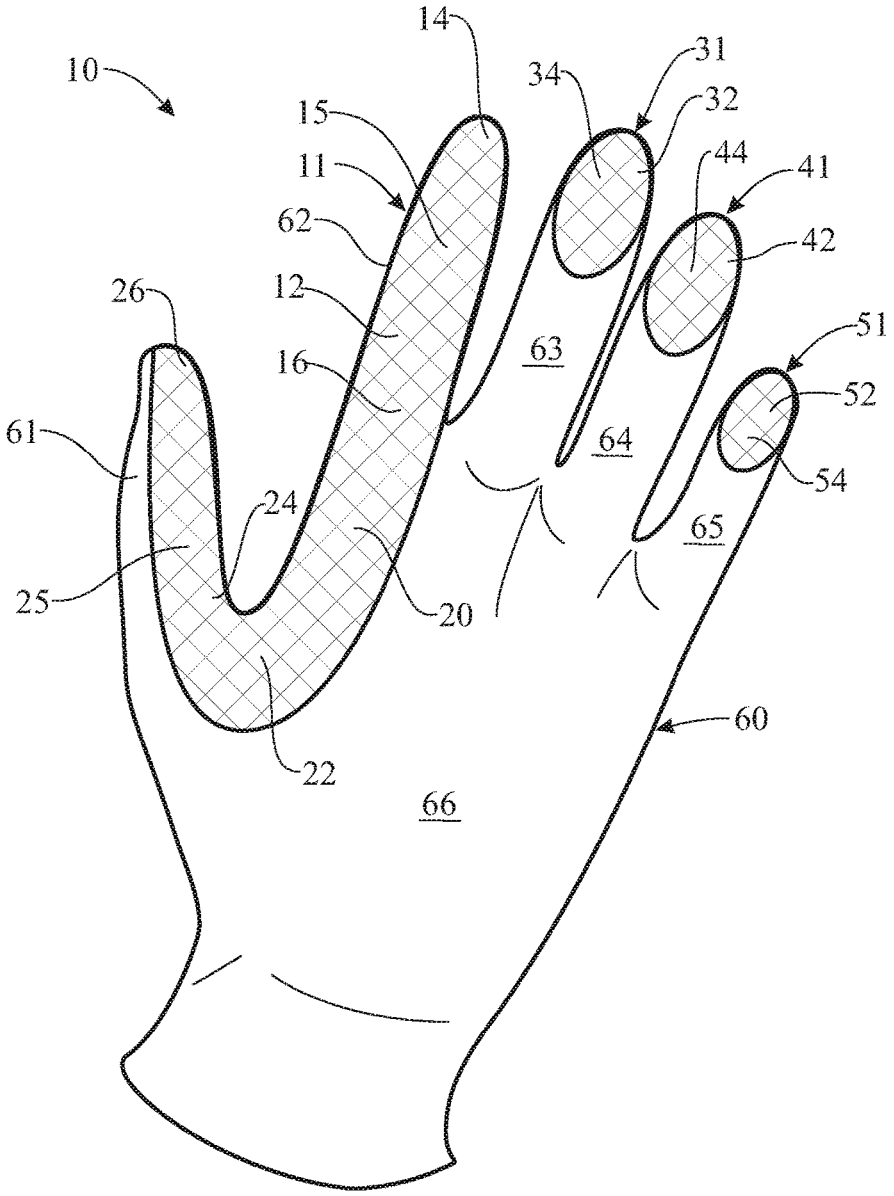
FIG. 2 presents the scrubbing patch set for gloves illustrated in FIG. 1, adhered to a glove in typical application of the patch set.

Referring initially to FIGS. 1 and 2, a scrubbing patch set 10 for gloves 60 is illustrated in accordance with an exemplary embodiment of the present invention. The scrubbing patch set 10 of the present embodiment includes an inner hand patch 11 which extends on a palm side 66 of the glove 60, covering the index finger, the thumb portion, and a generally strip-shaped inner palm region extending between the thumb and the index finger, providing a continuous scrubbing strip from the thumb to the index finger. The scrubbing patch set 10 of the present embodiment further includes, a middle finger patch 31 which covers generally the distal third of the middle finger 63 on the palm side 66 of the glove 60, a ring finger patch 41 which covers generally the distal third of the ring finger 64 on the palm side 66 of the glove 60 and a little finger patch 51 which covers generally the distal third of the little finger 65 on the palm side 66 of the glove 60. The patches 11, 31, 41 and 51 can be initially flat, and sufficiently flexible to bend and adopt a three-dimensional shape to confirm to hand, and allow for comfortable movement of the hand when wearing a glove fitted with the patches.

The inner hand patch 11 of the scrubbing patch set 10 may include an inner hand patch body 12. An inner hand patch adhesive cover 13, having substantially the same size and shape as the inner hand patch body 12, may be adhered to an adhesive back side (not numbered) of the inner hand patch body 12. The inner hand patch body 12 may have an index finger tip portion 14, an index finger middle portion 15 which extends from the index finger tip portion 14, an index finger base portion 16 which extends from the index finger middle portion 15, an inner palm portion 20 which extends from the index finger base portion 16, a finger junction portion 22 which extends from the inner palm portion 20, a thumb base portion 24 which extends from the finger junction portion 22, a thumb middle portion 25 which extends from the thumb base portion 24 and a thumb tip portion 26 which extends from the thumb middle portion 25. Accordingly, as illustrated in FIG. 2, the inner hand patch 11 may be sized and configured to cover generally the thumb 61 and the index finger 62 on at least an inner side or face thereof, as well as the inner palm region and the finger junction region between the thumb 61 and the index finger 62, of the glove 60.

The middle finger patch 31 of the scrubbing patch set 10 may include a middle finger patch body 32. A middle finger patch adhesive cover 33, having substantially the same size and shape as the middle finger patch 31, may be adhered to an adhesive back side (not numbered) of the middle finger patch body 32. The middle finger patch 31 may have at least a middle finger tip portion 34 which is sized and configured to cover at least generally the distal third of the middle finger 63 on the palm side 66 of the glove 60.

The ring finger patch 41 of the scrubbing patch set 10 may include a ring finger patch body 42. A ring finger patch adhesive cover 43, having substantially the same size and shape as the ring finger patch 41, may be adhered to an adhesive back side (not numbered) of the ring finger patch body 42. The ring finger patch 41 may have at least a ring finger tip portion 44 which is sized and configured to cover at least generally the distal third of the ring finger 64 on the palm side 66 of the glove 60.

The little finger patch 51 of the scrubbing patch set 10 may include a little finger patch body 52. A little finger patch adhesive cover 53, having substantially the same size and shape as the little finger patch 51, may be adhered to an adhesive back side 55 of the little finger patch body 52. The little finger patch 51 may have at least a little finger tip portion 54 which is sized and configured to cover at least generally the distal third of the little finger 65 on the palm side 66 of the glove 60.

For illustrative purposes, the little finger patch adhesive cover 53 is shown partially peeled off from the little finger patch body 52. Those skilled in the art will understand that a similar peel-off action can be carried out with the inner hand patch adhesive cover 13, middle finger patch adhesive cover 33, and ring finger patch adhesive cover 43. In other words, all adhesive covers 13, 33, 43, 53 can be peeled off of their respective patch bodies 12, 32, 42, 52 in order to reveal the adhesive back sides of their corresponding patch bodies 12, 32, 42, 52 and allow a user to adhere the patch bodies 12, 32, 42, 52 to the glove 60. In some applications, the user may instead choose to adhere the patch bodies 12, 32, 42, 52 directly to their fingers, without using a glove 60.

The inner hand patch body 12 of the inner hand patch 11, the middle finger patch body 32 of the middle finger patch 31, the ring finger patch body 42 of the ring finger patch 41 and the little finger patch body 52 of the little finger patch 51 may be fabricated of, for instance and without limitation, nylon, polyester, polyester cotton thread, polyester pad, nylon pad, cotton thread polyester, polyester sponge material, PET, non-woven fabric, microfiber 100% polyester, cloth, wool, duster, towel, flaw, wiper, natural scrubber, natural bristle, flexible silicon, natural sisal and/or other fabric or non-fabric material which is consistent with the functional requirements of the scrubbing patch set 10. The inner hand patch body 12 of the inner hand patch 11, the middle finger patch body 32 of the middle finger patch 31, the ring finger patch body 42 of the ring finger patch 41 and the little finger patch body 52 of the little finger patch 51 may be fabricated of a scour pad material known by those skilled in the art and may have different textures. In some embodiments, each of the inner hand patch body 12 of the inner hand patch 11, the middle finger patch body 32 of the middle finger patch 31, the ring finger patch body 42 of the ring finger patch 41 and the little finger patch body 52 of the little finger patch 51 may be about ⅛" in thickness.

The glove 60 to which the scrubbing patch set 10 is applied may include any of various materials which are consistent with the functional requirements of the scrubbing patch set 10. Non-limiting materials which are suitable for the purpose can include, for instance and without limitation, rubber, vinyl, latex, nitrile, neoprene, PVC (Poly Vinyl Chloride), TPE (Thermo Plastic Elastomer) and NBR (Nitrile Butadiene Rubber).

Figure 3:
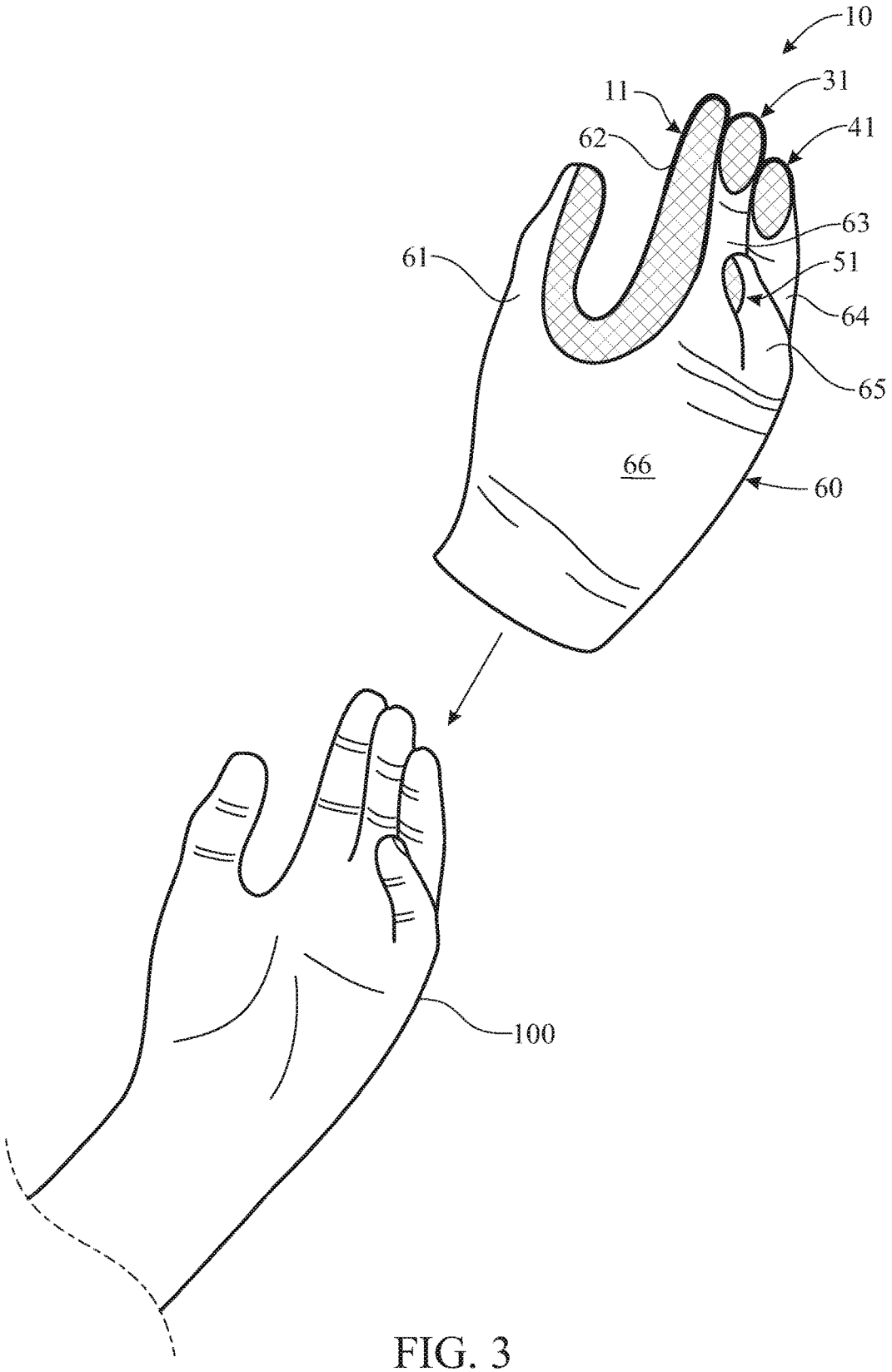
FIG. 3 is an exploded perspective view illustrating typical placement of the glove on a hand of a user with the patch set adhered to the glove.
Figure 4:
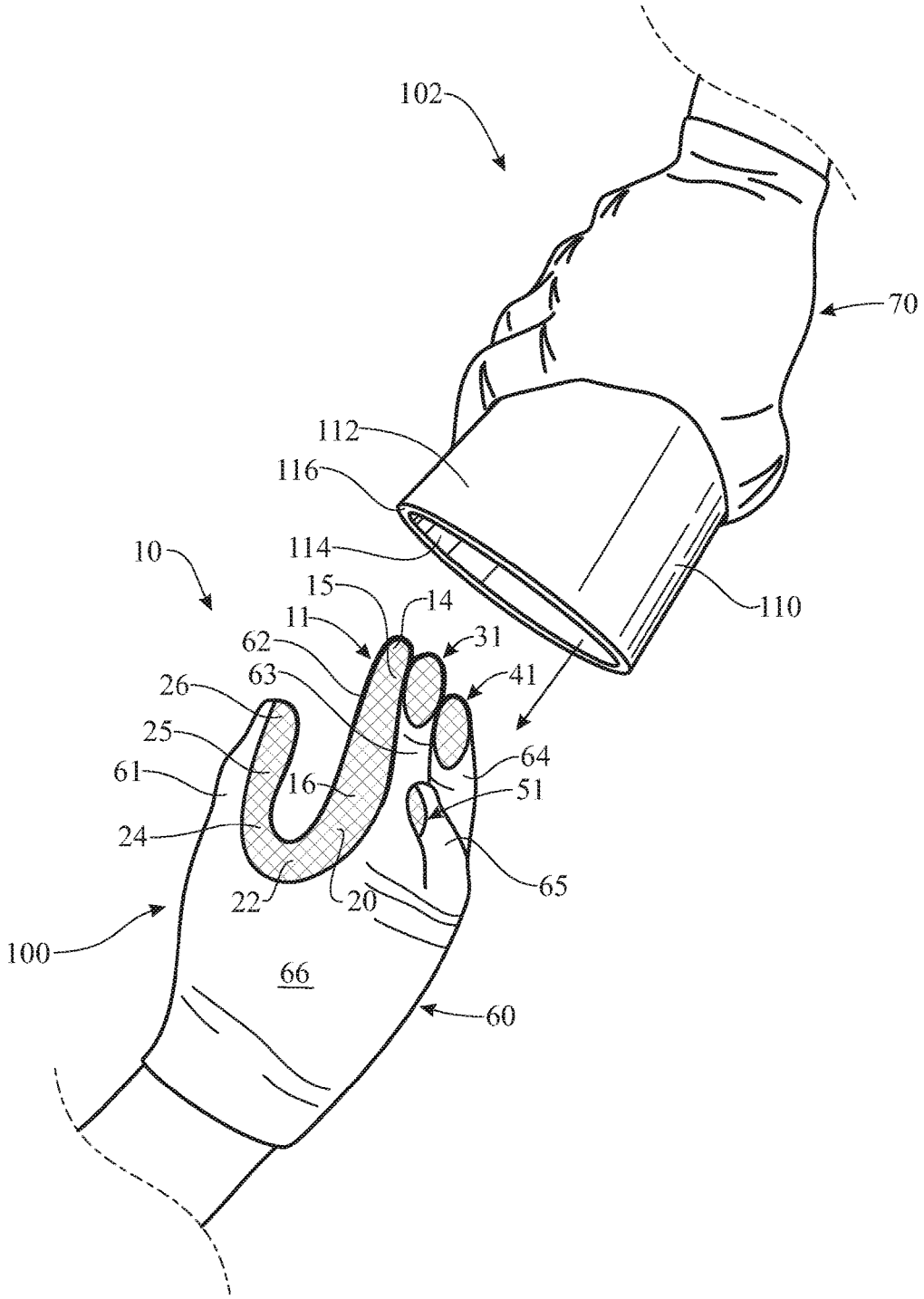
FIG. 4 is a perspective view of a pair of gloves, at least one of which includes the patch set adhered to the glove, preparatory to gripping of a cup in washing of the cup.

The illustrations of FIGS. 3 to 6 show a typical application of the scrubbing patch set 10 being used in combination with a pair of gloves 60, 70 for washing dishware such as a cup 110. As shown in FIGS. 3 and 4, a first glove 60 of the pair of gloves to which the scrubbing patch set 10 has been applied is donned on a left hand 100 of a user, while a second glove 70 of the pair of gloves is optionally donned on a right hand 102 of the user. Though not shown in the drawings, the second glove 70 can optionally be equipped with a scrubbing patch set 10 similar to that of the first glove 60, to allow the user to scrub with both hands.

Figure 5:
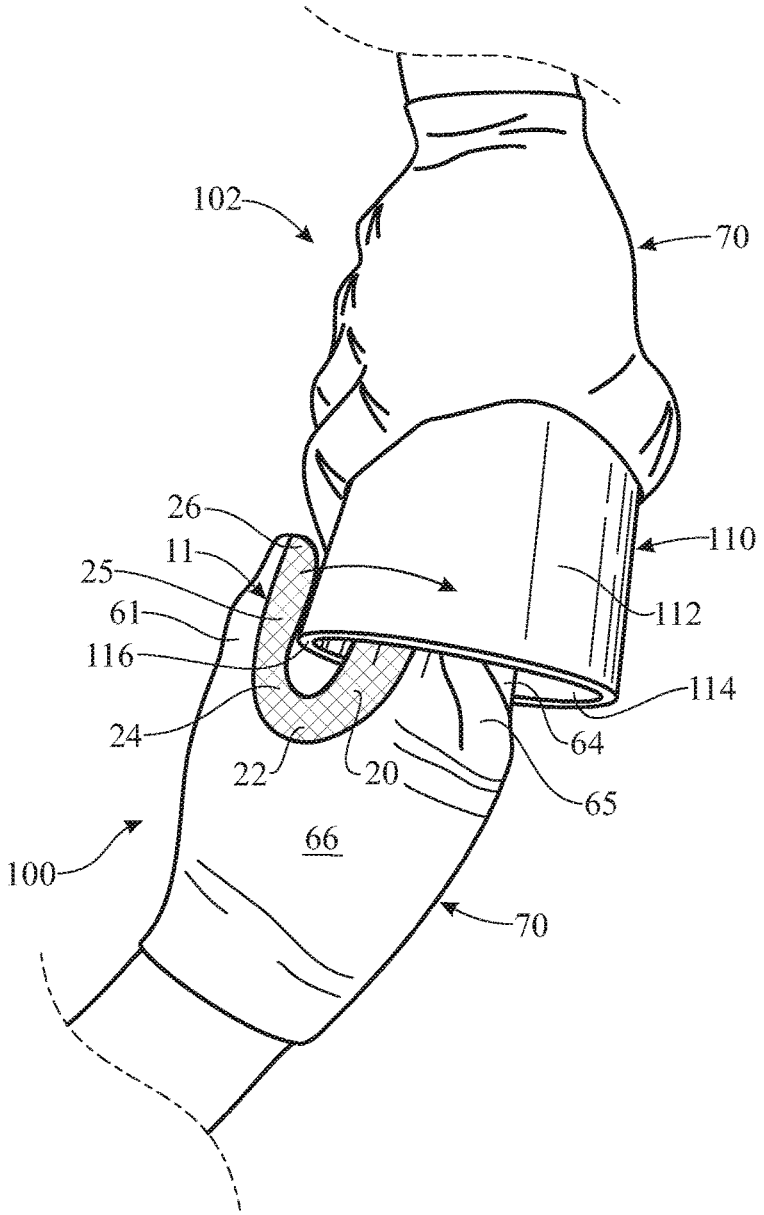
FIG. 5 is a perspective view of the pair of gloves illustrated in FIG. 4, more particularly illustrating gripping of the cup and back and forth movement of the left hand for washing of the cup.
Figure 6:
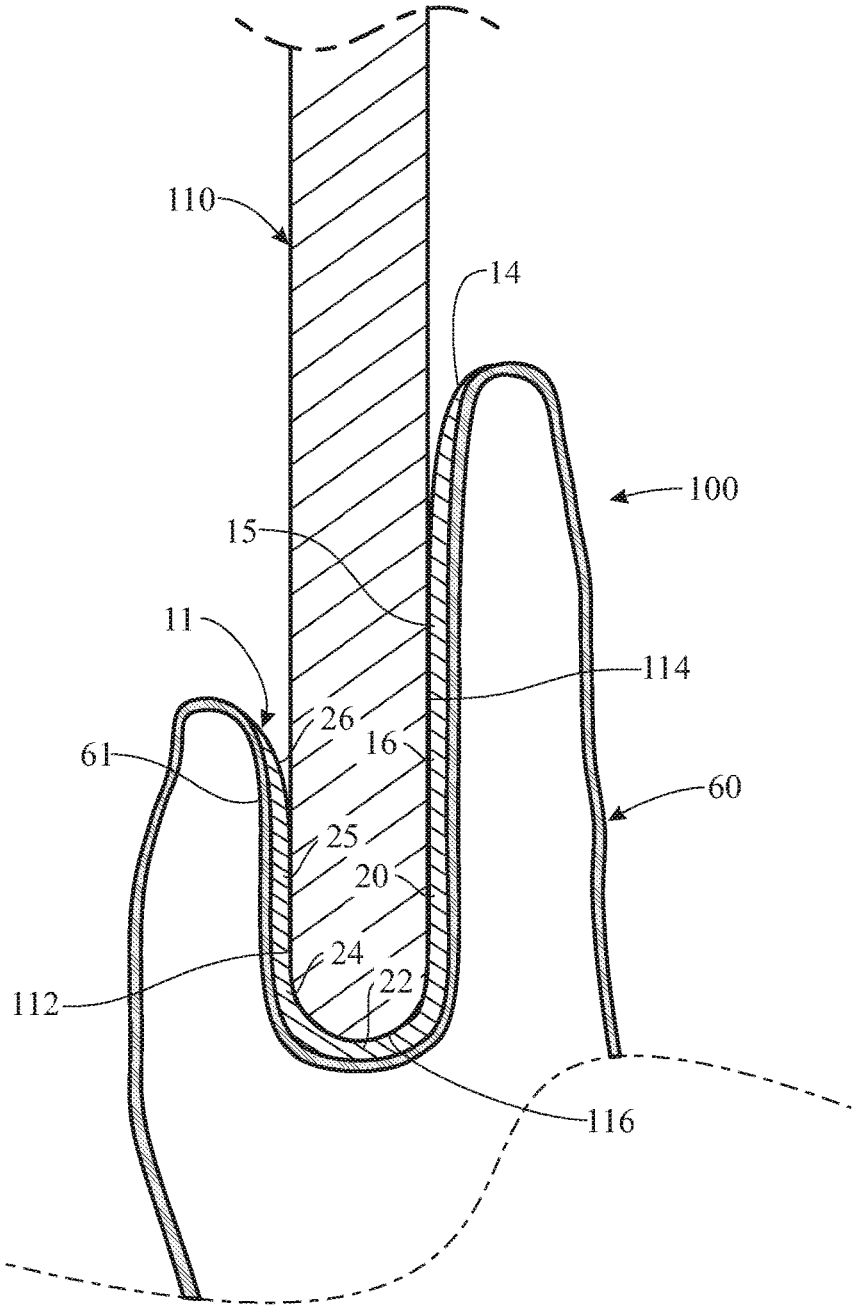
FIG. 6 is a schematic cross-sectional view of an inner hand patch of the patch set adhered to a glove, more particularly illustrating contact of the inner hand patch with the cup (also illustrated in cross-section)

As illustrated in FIGS. 4 and 5, the right hand 102 securely grasps the cup 110 while the left hand 100 on which the first glove 60 is donned engages the cup 110 such that the inner hand patch 11, the middle finger patch 31, the ring finger patch 41 and/or the little finger patch 51—preferably them all—contact the cup 110. The inner hand patch 11 can be applied against both the interior and exterior surface of the cup 110, providing an extremely efficient cleaning of the cup 110. The glove 60 can be moved against the dishware in a linear or circular motion (e.g. as shown by arrow A in FIG. 5), typically under running water in a sink, to remove food residue and the like from the dishware. More specifically, if the user places the hand 100 as shown in FIG. 5, the index finger middle portion 15 and index finger base portion 16 can scrub an inner surface 116 of the cup 110, while the thumb base portion 24 and thumb middle portion 25 can scrub an upper outer surface 112 of the cup 110. The user can also move his hand 110 so that the thumb tip portion 26 and the index finger tip portion 14 contact and scrub the cup 110 as well. In addition, bringing the hand closer to the cup 110 as shown in FIG. 6 allows the finger junction portion 22 of the inner hand patch 11 to contact and scrub a rim 116 of the cup 110. In addition, the user can easily insert the hand 100 into the cup 110 and scrub the bottom base of the cup 110 (not shown) with the index finger tip portion 14, the middle finger tip portion 34, the ring finger tip portion 44, and/or the little finger tip portion 54. In an alternative movement, the user can firmly grip the cup with the left hand 100, and move the right hand 102 in linear, circular or any other motion to clean the bottom outside surfaces of the cup 110. Thus, by simply moving his/her hands while securely gripping the cup 110, the user not only grip the cup 110 but also swiftly and efficiently scrub all inner and outer surfaces of the cup 110, not having to utilize a sponge, cloth or the like.

Normally, dish soap (not illustrated) is applied to the scrubbing patch set 10 on one or both of the first and second gloves 60, 70 to enhance removal of the food residue from the dishware. After use, the gloves 60, 70 may be removed from the hands of the user and discarded or cleaned, dried and re-used.

Figure 7:
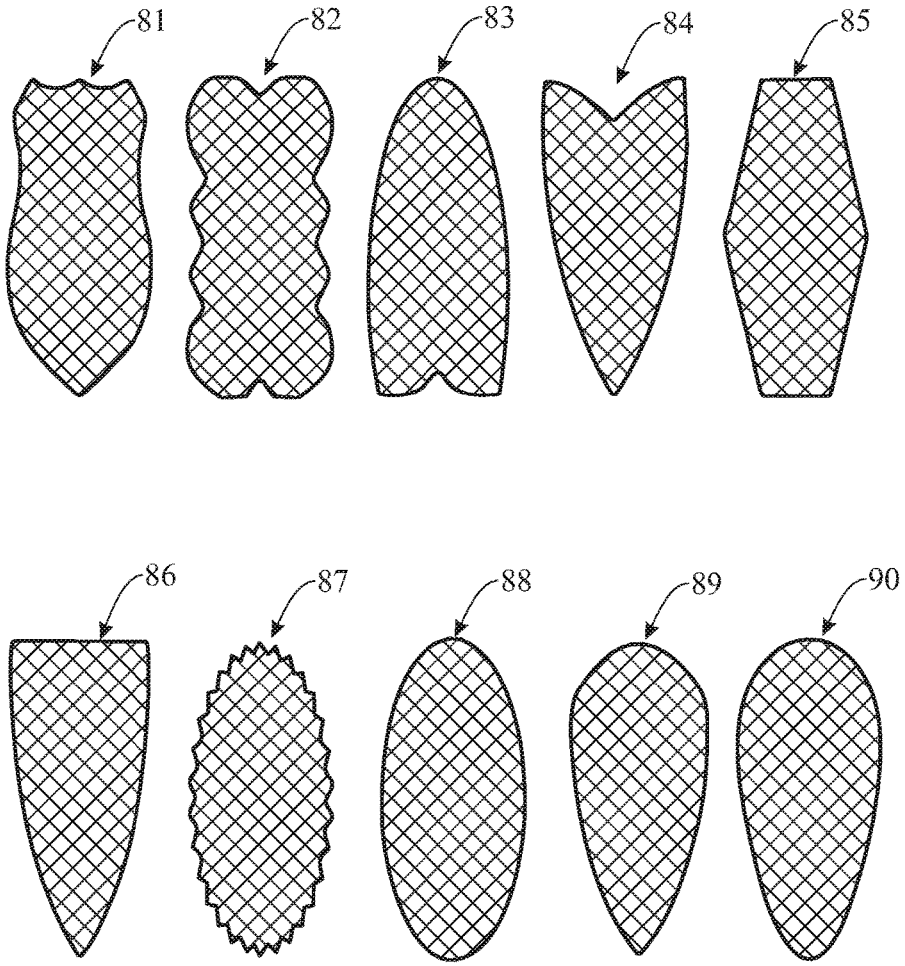
FIG. 7 illustrates various possible shapes for finger patches according to alternative embodiments of the scrubbing patch set for gloves.

Referring next to FIG. 7, it will be appreciated by those skilled in the art that various shapes are possible for the inner hand patch 11, the middle finger patch 31, the ring finger patch 41 and/or the little finger patch 51 according to various illustrative embodiments of the scrubbing patch set 10. These shapes may include, for example and without limitation, a badge-shaped finger patch 81; an elongated and notch-edged finger patch 82; a parabolic finger patch 83; a shield-shaped finger patch 84; an elongated hexagonal finger patch 85; an inverted parabolic finger patch 86; a scallop-edged finger patch 87; an elongated, oval finger patch 88; an elongated, tapered finger patch 89; and an elongated, almond-shaped finger patch 90. Moreover, the scrubbing patch set 10 may have various colors, sized and textures.

It will be appreciated by those skilled in the art that the scrubbing patch set 10 may minimize the area of the glove 60 need be covered by the hand and finger patches. In some embodiments, the scrubbing patch set 10 may cover about 30% of the total inner or palm area of the glove 60. This expedient may maximize dishware scrubbing and gripping performance and capability while minimizing soap, water and time.

Alternative embodiments are further contemplated. For instance, in some embodiments, any one of the patches can extend to the sides of the fingers and cover the sides partially. In other embodiments, any one of the patches can extend along the back side of the fingers (opposite to the palm side 66), for instance by having said patches comprise an end portion formed as a thimble or cap to be fitted onto the corresponding finger. It is also contemplated that the middle finger patch, ring finger patch and little finger patch may be sized and configured to cover a different relative length of the respective middle finger, ring finger and little finger on the palm side of the glove; for instance, the middle finger patch can cover the distal two-thirds of the middle finger, the ring finger patch can cover one-half of the ring finger, and the little finger can cover one-third of the little finger.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A scrubbing patch set for adhering to a glove having a thumb, an index finger, a middle finger, a ring finger, a little finger and a palm side, the palm side comprising a thumb portion, an index finger portion, a middle finger portion, a ring finger portion, a little finger portion and an inner palm portion extending from the index finger portion to the thumb portion, the scrubbing patch set comprising:

an adhesive, inner hand patch sized and configured to cover the index finger portion, the inner palm portion, and the thumb portion on the palm side;

an adhesive, middle finger patch sized and configured to cover at least a distal end of the middle finger portion on the palm side;

an adhesive, ring finger patch sized and configured to cover at least a distal end of the ring finger portion on the palm side; and an adhesive, little finger patch sized and configured to cover at east a distal end of the little finger portion on the palm side.

2. The scrubbing patch set of claim 1, wherein the inner hand patch is elongated and strip-shaped.

3. The scrubbing patch set of claim 1, wherein the middle finger patch is configured to cover at least a distal one-third of the middle finger portion on the palm side.

4. The scrubbing patch set of claim 1, wherein the ring finger patch is configured to cover at least a distal one-third of the ring finger portion on the palm side.

5. The scrubbing patch set of claim 1, wherein the little finger patch is configured to cover at least a distal one-third of the little finger portion on the palm side.

6. The scrubbing patch set of claim 1, wherein at least one of the inner hand patch, the middle finger patch, the ring finger patch and the little finger patch comprises an adhesive patch body and a cover attached to the patch body and removable from the patch body to expose an adhesive back of the patch body.

7. The scrubbing patch set of claim 1, wherein at least one of the inner hand patch, the middle finger patch, the ring finger patch and the little finger patch is flexible and deformable to adopt a flat, planar position.

8. The scrubbing patch set of claim 1, wherein the inner hand patch, the middle finger patch, the ring finger patch and the little finger patch are flexible and deformable to adopt a flat, planar position.

9. The scrubbing patch set of claim 1, wherein the inner hand patch comprises an index finger tip portion, an index finger middle portion which extends from the index finger tip portion, an index finger base portion which extends from the index finger middle portion, an inner palm portion which extends from the index finger base portion, a finger junction portion which extends from the inner palm portion, a thumb base portion which extends from the finger junction portion, a thumb middle portion which extends from the thumb base portion and a thumb tip portion which extends from the thumb middle portion.

10. The scrubbing patch set of claim 1, wherein the inner hand patch, the middle finger patch, the ring finger patch and the little finger patch are fabricated of at least one of nylon, polyester, polyester cotton thread, polyester pad, nylon pad, cotton thread polyester, polyester sponge material, PET, non-woven fabric, microfiber 100% polyester, cloth, wool, duster, towel, flaw, wiper, natural scrubber, natural bristle, flexible silicon and natural sisal.

11. The scrubbing patch set of claim 1, wherein at least one of the inner hand patch, the middle finger patch, the ring finger patch and the little finger patch is configured to further cover a side of a corresponding finger at least partially.

12. The scrubbing patch set of claim 11, wherein said at least one of the inner hand patch; the middle finger patch, the ring finger patch and the little finger patch is configured to further cover a back of said corresponding finger at least partially, said back opposite to said palm side.

13. A scrubbing patch set for adhering to a glove having a thumb, an index finger, a middle finger, a ring finger, a little finger and a palm side, the palm side comprising a thumb portion, an index finger portion, a middle finger portion, a ring finger portion, a little finger portion and an inner palm portion extending from the index finger portion to the thumb portion, the scrubbing patch set comprising:

an adhesive, inner hand patch sized and configured to cover the index finger portion, the inner palm portion, and the thumb portion on the palm side;

an adhesive, middle finger patch sized and configured to cover at least a distal one-third of the middle finger portion on the palm side;

an adhesive, ring finger patch sized and configured to cover at least a distal one-third of the ring finger portion on the palm side; and an adhesive, little finger patch sized and configured to cover at least a distal one-third of the little finger portion on the palm side.

14. The scrubbing patch set of claim 13, wherein the inner hand patch is elongated and strip-shaped.

15. The scrubbing patch set of claim 13, wherein at least one of the inner hand patch, the middle finger patch, the ring finger patch and the little finger patch comprises an adhesive patch body and a cover attached to the patch body and removable from the patch body to expose an adhesive back of the patch body.

16. The scrubbing patch set of claim 13, wherein at least one of the inner hand patch, the middle finger patch, the ring finger patch and the little finger patch is flexible and deformable to adopt a flat, planar position.

17. The scrubbing patch set of claim 13, wherein the inner hand patch, the middle finger patch, the ring finger patch and the little finger patch are flexible and deformable to adopt a flat, planar position.

18. The scrubbing patch set of claim 13, wherein the inner hand patch comprises an index finger tip portion, an index finger middle portion which extends from the index finger tip portion, an index finger base portion which extends from the index finger middle portion, an inner palm portion which extends from the index finger base portion, a finger junction portion which extends from the inner palm portion, a thumb base portion which extends from the finger junction portion, a thumb middle portion which extends from the thumb base portion and a thumb tip portion which extends from the thumb middle portion.

19. A scrubbing patch set for adhering to a glove having a thumb, an index finger, a middle finger, a ring finger, a little finger and a palm side, the palm side comprising a thumb portion, an index finger portion, a middle finger portion, a ring finger portion, a little finger portion and an inner palm portion extending from the index finger portion to the thumb portion, the scrubbing patch set comprising:

an adhesive and elongated inner hand patch sized and configured to cover the index finger portion, the inner palm portion, and the thumb portion on the palm side;

an adhesive, middle finger patch sized and configured to cover at least a distal one-third of the middle finger portion on the palm side;

an adhesive, ring finger patch sized and configured to cover at least a distal one-third of the ring finger portion on the palm side; and an adhesive, little finger patch sized and configured to cover at least a distal one-third of the little finger portion on the palm side; wherein the inner hand patch, the middle finger patch, the ring finger patch and the little finger patch comprise a respective adhesive patch body and a respective cover attached to the respective patch body and removable from the respective patch body to expose an adhesive back of the respective patch body; and further wherein the inner hand patch, the middle finger patch, the ring finger patch and the little finger patch are flexible and deformable to adopt a flat, planar position.

20. The scrubbing patch set of claim 19, wherein the inner hand patch comprises an index finger tip portion, an index finger middle portion which extends from the index finger tip portion, an index finger base portion which extends from the index finger middle portion, an inner palm portion which extends from the index finger base portion, a finger junction portion which extends from the inner palm portion, a thumb base portion which extends from the finger junction portion, a thumb middle portion which extends from the thumb base portion and a thumb tip portion which extends from the thumb middle portion.

* * * * *